US006599100B2

(12) United States Patent
Abe et al.

(10) Patent No.: US 6,599,100 B2
(45) Date of Patent: Jul. 29, 2003

(54) CLOSED TYPE MOTOR-OPERATED COMPRESSOR

(75) Inventors: Nobuo Abe, Oohira (JP); Yoshihiro Sasaki, Oohira (JP); Kazuya Ishigami, Oohira (JP); Kazunori Morita, Kanuma (JP); Masahiro Shimada, Oohira (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/859,510

(22) Filed: May 18, 2001

(65) Prior Publication Data

US 2002/0034451 A1 Mar. 21, 2002

(30) Foreign Application Priority Data

Sep. 20, 2000 (JP) ..... 2000-290344

(51) Int. Cl.[7] ..... F04B 23/00; F04B 17/00; F01C 1/02

(52) U.S. Cl. ..... 417/313; 417/366; 418/55.6; 418/DIG. 1

(58) Field of Search ..... 417/313, 366, 417/410.5; 184/6.16; 418/55.6, DIG. 1

(56) References Cited

U.S. PATENT DOCUMENTS

| | | | | |
|---|---|---|---|---|
| 5,176,506 A | * | 1/1993 | Siebel | 184/6.16 |
| 5,304,045 A | * | 4/1994 | Hoshino et al. | 417/372 |
| 6,135,738 A | * | 10/2000 | Kajiwara et al. | 418/55.6 |
| 6,231,317 B1 | * | 5/2001 | Watanabe et al. | 417/410.5 |
| 6,280,155 B1 | * | 8/2001 | Dreiman | 417/410.5 |

* cited by examiner

*Primary Examiner*—Charles G. Freay
*Assistant Examiner*—Michael K. Gray
(74) *Attorney, Agent, or Firm*—Antonelli, Terry, Stout & Kraus, LLP

(57) ABSTRACT

In a closed type motor-operated compressor, oil covers are provided at the upper and lower portions of a stator, as well as a porous filter provided between the lower portion coil cover and a support member for supporting a sub-bearing, wherein it is so constructed that gas discharged passes through the filter with certainty after passing through a space defined by an inner diameter of a sealed container and a constituent element(s) of a compressor mechanism, thereby dissolving a problem of decreasing heat change efficiency in a refrigerating cycle due to much of discharge of refrigerating machine oil from a discharge pipe to the refrigerating cycle.

16 Claims, 5 Drawing Sheets

CLOSED TYPE MOTOR-OPERATED COMPRESSOR

BACKGROUND OF THE INVENTION

1. Field of the Invention

The present invention relates to a closed type motor-operated compressor, and mainly relates to the closed type motor-operated compressor for use in air conditioning and refrigerating, in particular, being suitable for achieving improvement on performances of refrigerating cycle thereof.

2. Description of Prior Art

The prior art will be explained by referring to Japanese Patent Laying-open No. Hei 5-99182 (1993) and Japanese Patent Laying-open No. 2000-073977 (2000), in particular, the structure of the closed type motor-operated compressor according to the conventional art, shown in FIG. 6 attached therewith, while constituent members or elements relating thereto in FIGS. 7 and 8.

FIG. 6 is the cross-section view for showing an example of the conventional closed type motor-operated compressor 21. Namely, in a central portion of a cylindrical case 23 as a main body of a hermetically sealed container 22, being welded with a cover chamber 24 at the upper portion and with a bottom chamber at the lower portion thereof, a stator 26*a* of a motor 26 is disposed on an outer side while a rotor 26*b* on an inner side, and a compression mechanism portion 27, which is directly connected to the rotor 26*b* by means of a crankshaft 28, is disposed in an upper portion thereof. Also, a sub- or auxiliary bearing 33 connected with the lower end side of the crank shaft 28 and a support portion 34 (with bores 34*a*) for supporting the auxiliary bearing 33, which has a hole or bore for collecting circulating refrigerating machine oil therethrough, are disposed in a lower portion of the case 23. Also, within the lowest portion of the sealed container 22 on a side of the bottom chamber 25 is enclosed the refrigerating machine oil 35.

The compressor mechanism portion 27 is formed with a stationary scroll 32, which is screwed to a frame 29 by means of a bolt(s). The frame 29 comprises a bearing 29*b* for insertion of the crankshaft 28, and a hole 29*c* for receiving discharge pipe 23*a*. Between the stationary scroll 32 and the frame 29 is provided a rotational scroll 31. A swirl 31*d* of the rotational scroll 31 and a swirl 32*b* of the stationary scroll 32 are assembled together in such a manner that the rotational scroll 31 is able to wobble freely. The compressor mechanism portion 27 receives the rotational scroll 31 within a step-wise portion 29*a* of the frame 29, while keeping it freely slidable thereon. In the compressor mechanism portion 27, for the purpose of preventing the rotational scroll 31 from rotating on its own axis, there is provided an Oldham ring 30 having keys 30*a*, being formed on upper and lower surfaces of the ring, so that they cross at right angles to one another. Those keys 30*a* are inserted into key groove (not shown in the figure) of the frame 29 and the key seats 31*a* of the rotational scroll 31, respectively.

Oil supply to the compressor mechanism portion 27 is provided, for the purpose of lubricating the crankshaft 28 and the frame 29, the bearing portions 29*b* and 31*c* of the rotational scroll 31, and sliding surfaces of the key groove of the rotational scroll 31 and the frame 29 and the keys 30*a* of the Oldham ring 30, respectively, and also improving a property of gas sealing between the swirls 32*b* and 31*d* of the stationary scroll 32 and the rotational scroll 31, between a mirror plate 31*b* of the rotational scroll 31 and the step-wise portion 29*a* of the frame 29, and between end surfaces 32*c* of the stationary scroll 32, wherein the refrigerating machine oil 35 in a lower portion of the sealed container 22 is loaded at an intermediate pressure between an discharge pressure and a suction pressure of the compressor, so that it is supplied to each portion through an oil supply bore 28*a* opened in a central portion of the crankshaft 28.

With such the conventional closed type motor-operated compressor 21 already-known, refrigerant gas (hereinafter, "suction gas"), which is enclosed within the refrigerating cycle in advance, is sucked from a suction pipe 24*a* connecting between an external portion of the sealed container 22 and the stationary scroll 32, due to pumping function of a compressor chamber defined by the swirls 32*b* and 31*d* of the stationary scroll 32 and the rotational scroll 31, accompanying the rotation of the motor 26, and after being compressed sequentially, it is discharged within the sealed container 22, in a form of high pressure gas (hereinafter, "discharge gas"), from a discharge hole 32*a* which is opened in the vicinity of a center of the stationary scroll 32.

In this instance, the refrigerating machine oil, which is supplied onto the sliding surfaces for improving reliability as was mentioned in the above, as well as the same one that is supplied onto sealing surfaces for improving the property of gas sealing, is mixed with the suction gas to be compressed, and it is discharged into the sealed container 22 under a condition of mist together with the discharge gas. This gas flows out from a discharge pipe 23*a* of the case 23 into the refrigerating cycle (not shown in the figure) in the outside of the sealed container 22, and the refrigerating machine oil of the mist-like condition adheres in the form of an oil film onto an inner surface of a pipe (not shown in the figure) of the refrigerator, thereby preventing heat radiation in a heat exchanger and reducing down an efficiency in heat exchange thereof, therefore it is impossible to achieve good performance on an air conditioner and refrigerating machines.

Then, in the conventional closed type motor-operated compressor 21, for suppressing the flow-out of the oil mist contained within the discharge gas into the refrigerating cycle, a shielding space or room 38 is formed by using a lower side of the frame 29 of the compressor mechanism portion 27, an oil ring 36 between an upper end coil 26*c* of the motor 26, and an oil cover 37 having a bent portion 37*a* which covers an outer diameter side and an upper surface of the upper end coil 26*c*, wherein a tip of the discharge pipe 23*a* projecting from the case 23 is inserted within the shielding space 38, penetrating through a cutting 36*a* which is provided in a portion of the above-mentioned oil ring 36, then no discharge gas flows into the discharge pipe 23*a* directly from a space between the frame 29 and the motor 26.

Namely, explaining the method for preventing the flow-out of oil mist in more details thereof, the shielding space 38 is formed by using both members of the oil ring 36 mentioned above and the oil cover 37, while inserting the tip of the discharge pipe 23*a* into the said shielding space 38, therefore the discharge gas containing the mist-like refrigerating machine oil therein, being discharged from the compressor mechanism portion 27, as shown by an arrow in the FIG. 6, and passing through a space or gap defined by the inner diameter of the case 23 and an outer periphery cut portion 26*f* of a core 26*e* of the motor 26, goes past lower part end coil 26*d* and up within an air gap between the stator 26*a* and the rotor 26*b* from a lower portion of the motor 26, thereby being guided to the discharge pipe 23*a*.

As a result of this, comparing to the case of no such the shielding space 38, since the passage of the discharge gas is long and the passage is continuous while being reduced down or expanded in the cross-section area thereof, the mist-like refrigerating machine oil 35 mixed within the discharge gas is separated from, and it is liquefied to drip into the lower portion of the sealed container 22. The refrigerating machine oil flowing into the refrigerating cycle is restricted in flow-out amount thereof at a certain degree, therefore it is possible to relieve formation of oil film within the pipe of the refrigerating cycle, thereby to improve the performance of heat-exchange in the air conditioner or the refrigerating machines.

FIG. 7 is a perspective view for showing an example of a shape of the oil ring 36. FIG. 8 is a perspective view for showing an example of a shape of the oil cover 37.

Both of the members have cylindrical portions being concentric with an axis of the closed type motor-operated compressor, wherein the oil cover 37 is formed with a bent portion 37*a* of width for covering the upper surface of the upper end coil 26*c*, while the oil ring 36 has a diameter size within the range of the width of the bent portion 37*a* of the oil cover 37, and those both members, as shown in the FIG. 6, are elastically engaged with between the frame 29 and the end surface of the core 26*e* of the motor 26, by using elasticity of the bent portion 37*a* of the oil cover 37. In this instance, in general, both members are made from a resin film that has a property of electric insulation.

In the closed type motor-operated compressor explained as the conventional art in the above, the passage for the compressed gas is arranged in the structure, so that large one and small one are mixed with in the cross-section area thereof, to decelerate the flow velocity of the gas therein, thereby condensing the oil mist indirectly, so as to bring about dews along the gas passage, to drip it into the lower portion of the compressor.

However, because of an intention of saving electric power increasing more and more in the industry of the air conditioner and the refrigerating machines, it is a proposition to obtain an improvement on the performance of the heat exchanger, and there is a necessity of preventing the oil from further flowing out into the pipe of the refrigerating machine, to improve the performance or capacity of heat radiation of the pipe, therefore there is a demand of separating the oil from the discharge gas more than that in the conventional closed type motor-operated compressor.

SUMMARY OF THE INVENTION

According to the present invention, it is an object to provide a closed type motor-operated compressor, wherein the refrigerating machine oil is further prevented from flowing out from the compressor into the refrigerating cycle than that in the conventional art, with less oil in the refrigerating cycle system being less of a deterrent for heat dissipation, thereby increasing the efficiency of heat exchange by the heat exchanger thereof.

For accomplishing the object mentioned above, according to the present invention, there is provided a closed type motor-operated compressor, wherein the oil is separated from the refrigerant gas, which is compressed within the compressor, by using a filter with high efficiency.

DETAILED DESCRIPTION OF PREFERRED EMBODIMENT(S)

Figure 1:
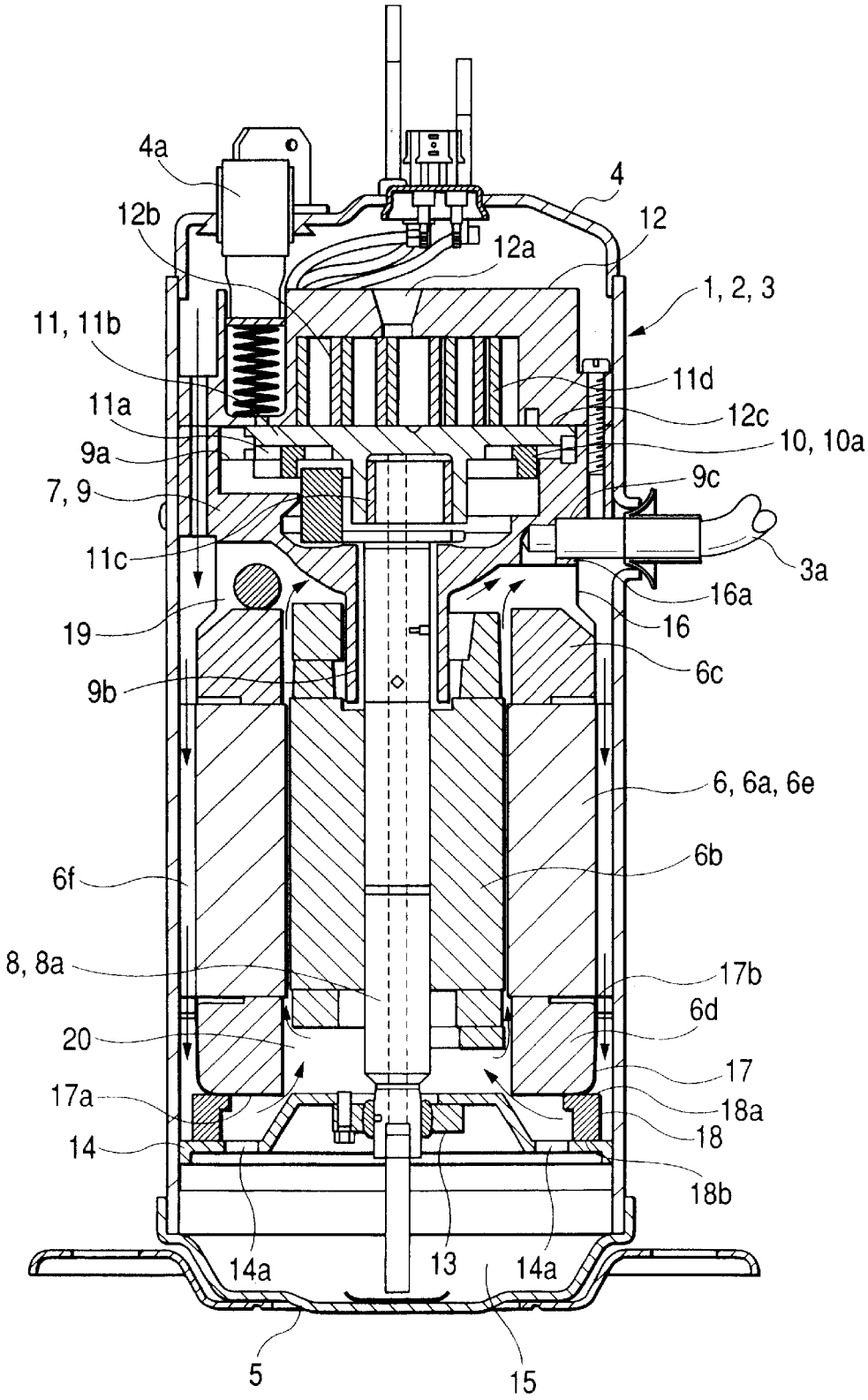
FIG. 1 is a side cross-section view for showing an embodiment of the closed type motor-operated compressor according to the present invention.

Hereinafter, FIG. 1 shows the structure of a closed type motor-operated compressor, according to an embodiment of the present invention. Also, examples of the components thereof will be shown partially by referring to FIGS. 2 to 4, which are provided for separation of refrigerating machine oil from refrigerant gas compressed within a compressor. Also, an effect of lowering discharge amount of oil in the present embodiment is shown in FIG. 5.

FIG. 1 shows a side cross-section view of the closed type motor-operated compressor 1, according to the embodiment of the present invention. Namely, in a central portion of a case 3, i.e., a main body of a sealed container, being attached with a cover chamber 4 at an upper portion thereof while with a bottom chamber 5 at a lower portion thereof, a stator 6*a* and a rotor 6*b* of a motor 6 are disposed on an outside and an inside thereof, while disposing a compressor mechanism portion 7, which is directly connected to the rotor 6*b* by means of a crankshaft 8, in an upper portion thereof. Also, a sub-bearing 13, being connected to the crankshaft 8 at a lower end side thereof, and a disc 14, having a bore 14*a* and functioning as a supporting member for supporting the sub-bearing 13 thereby, are disposed in a lower portion thereof. Further, within a lowest portion of a bottom chamber 5 of the sealed container 2 is enclosed refrigerating machine oil 15.

The compressor mechanism portion 7 is formed with a stationary scroll 12, which is connected to a frame 9 through a bolt. The frame 9 comprises a bearing 9*b* for insertion of the crankshaft 8 therein, and a hole 9*c* for receiving discharge pipe 3*a*. Between the stationary scroll 12 and the frame 9 is provided a rotational scroll 11. A swirl lid of the rotational scroll 11 and a swirl 12*b* of the stationary scroll 12 are assembled or meshed to each other, in such a manner that the rotational scroll 11 is able to oscillate freely. The compressor mechanism portion 7 receives the rotational scroll 11 within a step-wise portion 9*a* of the frame 9, while keeping it freely slidable thereon. In the compressor mechanism portion 7, for the purpose of preventing the rotational scroll 11 from rotating on its own axis, there is provided an Oldham ring 10 having keys 10*a*, being formed on upper and lower surfaces of the ring, so that they cross at right angles to one another. Those keys 10*a* are inserted into key grooves (not shown in the figure) of the frame 9 and the key grooves 11*a* of the rotational scroll 11, respectively.

Oil supply to the compressor mechanism portion 7 is provided for the purpose of lubricating the crankshaft 8, the frame 9 and the bearing portions 9*b* and 11*c* of the rotational scroll 11, and between sliding surfaces of the key grooves of the rotational scroll 11 and the frame 9 and the keys 10*a* of the Oldham ring 10, respectively, and also for improving the property of gas sealing between the swirls 12*b* and lid of the stationary scroll 12 and the rotational scroll 11, between a mirror plate 11*b* of the rotational scroll 11 and the step-wise portion 9*a* of the frame 9, and between end surfaces 12*c* of the stationary scroll 12, wherein the refrigerating machine oil 15, in a lower portion of the sealed container 2, is loaded at an intermediate pressure between a discharge pressure and a suction pressure of the compressor, so that it is supplied to each portion through an oil supply bore 8*a* opened in a central portion of the crankshaft 8.

With this closed type motor-operated compressor 1, refrigerant gas (hereinafter, "suction gas"), which is enclosed within the refrigerating cycle in advance, is sucked from a suction pipe 4*a* connecting between a refrigerant pipe (not shown in the figure) in an outside of the sealed container 2 and the stationary scroll 12 directly, due to pumping function of a compressor chamber defined by the swirls 12*b* and lid of the stationary scroll 12 and the rotational scroll 11, accompanying the rotation of the motor, and after being compressed sequentially, it is discharged within the sealed container 2, as high pressure gas (hereinafter, "discharge gas"), from a discharge bore 12*a* which is opened in the vicinity of a center of the stationary scroll 12.

In this instance, the refrigerating machine oil, which is supplied onto each the sliding surface and the swirl or the mirror plate surface of the rotational scroll 11 for improving the reliability mentioned above and the property of gas sealing, is mixed with the suction gas to be compressed, and it is discharged into the sealed container 2 under a condition of mist together with the discharge gas. The oil adheres in a form of oil film onto an inner surface of a refrigerating cycle (not shown in the figure) in the outside of the sealed container 2, thereby disturbing heat radiation in a heat exchanger and reducing down efficiency in heat exchange, therefore it is impossible to obtain good performance thereof for an air conditioner and refrigerating machines.

While, on a side of the lower part end coil 6*d* of the motor is provided a lower part coil cover 17, being formed in a shape including a bottom 17*a* covering an outer diameter and a lower side of the end coil 6*d*, so that circumference end surface 17*b* thereof contacts on a lower end surface of the core 6*e*, as shown in the FIG. 1. Further, below the lower coil cover 17 is provided a ring-like porous filter 18 having a certain thickness and width, wherein a lower end surface 18*b* thereof is adhered closely onto the disc 14 for supporting the sub-bearing 13 while an upper end surface 18*a* onto a lower end surface of the bottom portion 17*a* of the lower part coil cover 17, thereby comprising a lower part shielding space 20.

As was mentioned in the above, in the closed type motor-operated compressor 1 according to the present embodiment, the shielding spaces 19 and 20 are comprised at the upper and lower sides of the motor 6, respectively, therefore the discharge gas containing the oil mist passes through, as shown by an arrow of solid line, from the discharge hole 12*a* of the stationary scroll 12 through a bore of the frame 9, and it further goes down through the space defined by the upper part oil cover 16 and the inner diameter of the case 3, in an air gap defined between a cut portion 6*f* on an outer periphery of core of the motor 6 and the inner diameter of the case 3.

Further, the discharge gas containing the oil mist reaches to a space defined by the lower oil cover 17 and the outer diameter of the filter 18 and the inner diameter of the sealed container 3, and then it passes through fine holes of the porous filter 18. Through the lower shielding space 20, it rises up in a fine air gap defined between the stator 6*a* and the rotor 6*b* of the motor 6, so as to reach the upper shielding space 19, and after that it is guided into the discharge pipe 3*a*, which projects into the upper shielding space 19.

Namely, comparing to the conventional closed type motor-operated compressor, the flow passage for the discharge gas is restricted within the closed type motor-operated compressor in this embodiment, and the lower oil cover 17 is provided for covering a lower portion of the motor 6, i.e., the lower part end coil 6*d*, so that the discharge gas passes through the porous filter 18 in the ring-like shape after passing through the air gap defined by the cut portion 6*f* on the outer periphery of the core and the inner diameter of the case 3. The porous filter 18 is constructed so that it fills up with a gap defined between the lower oil cover 17 and the disc 14 which partitions between the bottom chamber 5 in which the refrigerating machine oil 15 is accumulated, and the motor 6.

With such the construction in the closed type motor-operated compressor 1 according to the present embodiment, when the discharge gas passes through the filter 18, the gas, being filtered out the oil mist therefrom when it passes through the air gap, flows out into the discharge pipe 3*a*, as shown by the arrow of solid line, while the mist filtered out by the filter is liquefied, so as to be collected from the lower portion of the filter 18 through the hole 14*a* of the disc 14 into the lower portion of the sealed container 2, as shown by an arrow of dotted line.

As a result of this, comparing to such the case of no filter provided as shown in the FIG. 5, it is possible to reduce the discharge amount of the refrigerating machine oil into the refrigerating cycle, greatly, in a case where the filter is provided according to the embodiment, into which the present invention is applied.

Figure 2:
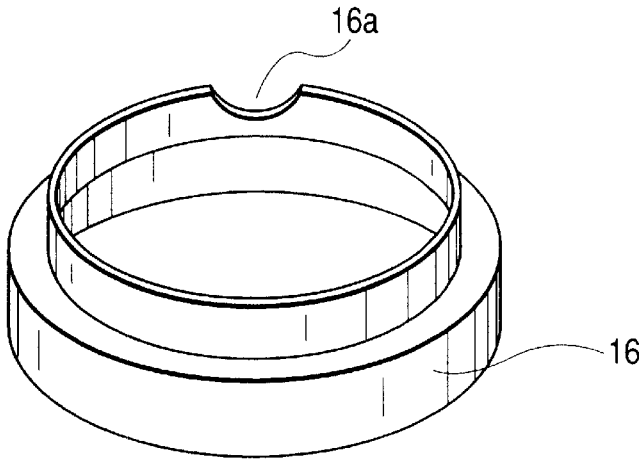
FIG. 2 is a perspective view of an upper part oil cover according to the embodiment of the present invention.

FIG. 2 is a perspective view for showing an example of the shape of the upper part oil cover 16, according to the present invention. Namely, this has a cylindrical shape with stages, being concentric with the axis of the closed type motor-operated compressor, having an inner diameter at the lower side thereof, which is larger a little bit than the outer diameter of the upper end coil 6*c* of the motor 6, and having an inner diameter at the upper side within allowable ranges of an inner/outer diameter size of the end coil 6*c*, and the oil cover 16 has a portion opened an insertion hole 16*a* for the discharge pipe 3*a* of the sealed container 2. The upper part oil cover 16 may be made of an electric insulating material such as, for example, resin. Herein, the upper oil cover 16 shown in the FIG. 2 is in a form of one body, however it may be structured with two members, being divided at the stage portion of the cylinder-like form with the stages mentioned above, for example, so far as a closed space can be structured as the flow passage for the discharge gas therein, between the lower side of the frame 9 of the compressor mechanism portion 7 and the upper surface of the core 6*e* of the motor 6 in the structure thereof.

Figure 3:
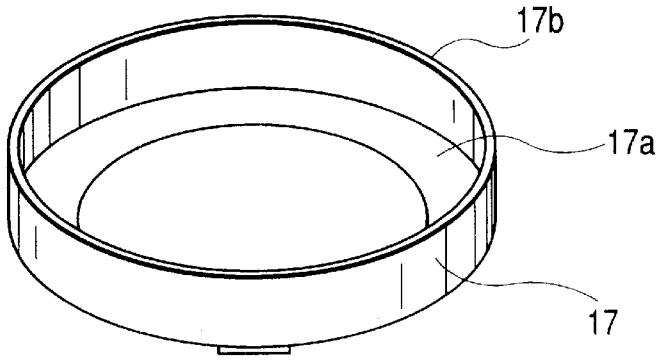
FIG. 3 is a perspective view of a lower part oil cover according to the embodiment of the present invention.

FIG. 3 shows an example of the shape of the lower part oil cover 17. This has also a cylindrical shape, being concentric with the axis of the closed type motor-operated compressor and structured with a circumferential plane portion 17*b* to be abutted on the end surface of the core 6*e* of the motor 6, a cylindrical portion having an inner diameter being a little bit larger than the outer diameter of the lower part end coil 6*d*, and a surface of the bottom 17 of an arbitrary width which is connected with that cylindrical portion, in one body.

With the material of the oil covers shown in the FIGS. 2 and 3, it is preferably structured of an electric insulation material, since it is located in the vicinity of the end coil of the motor 6.

Figure 4:
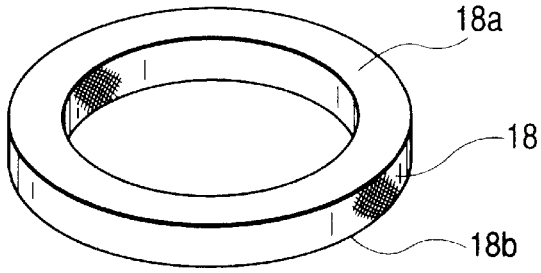
FIG. 4 is a perspective view of a filter according to the embodiment of the present invention.
Figure 5:
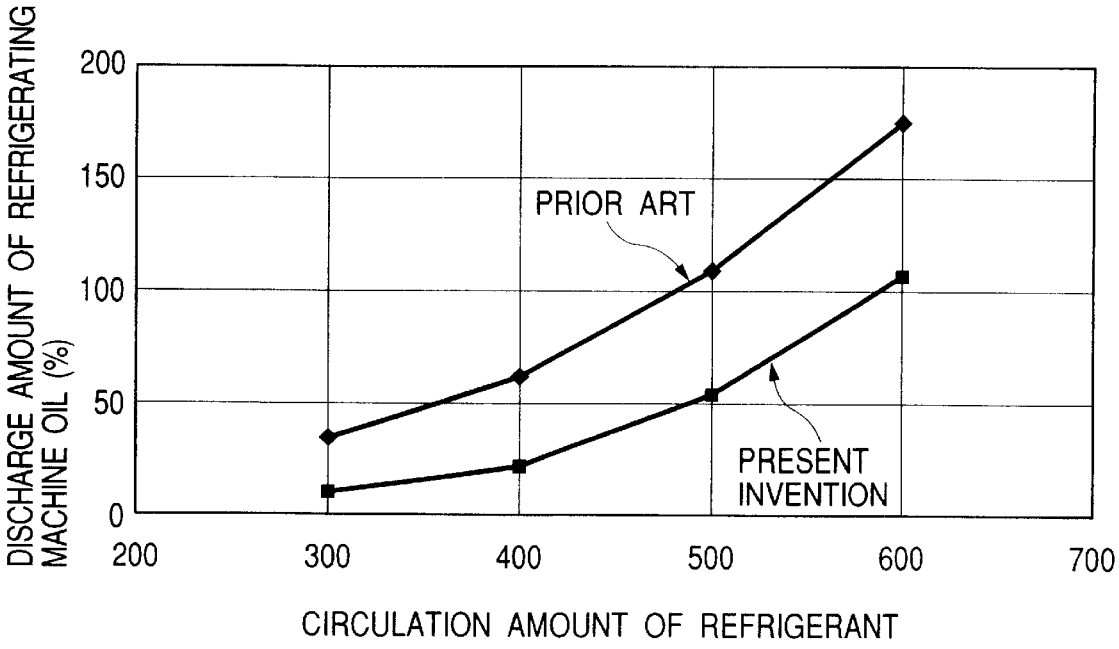
FIG. 5 is a graph for showing an example of an effect of lowering a discharge amount of oil according to the present invention.
Figure 6:
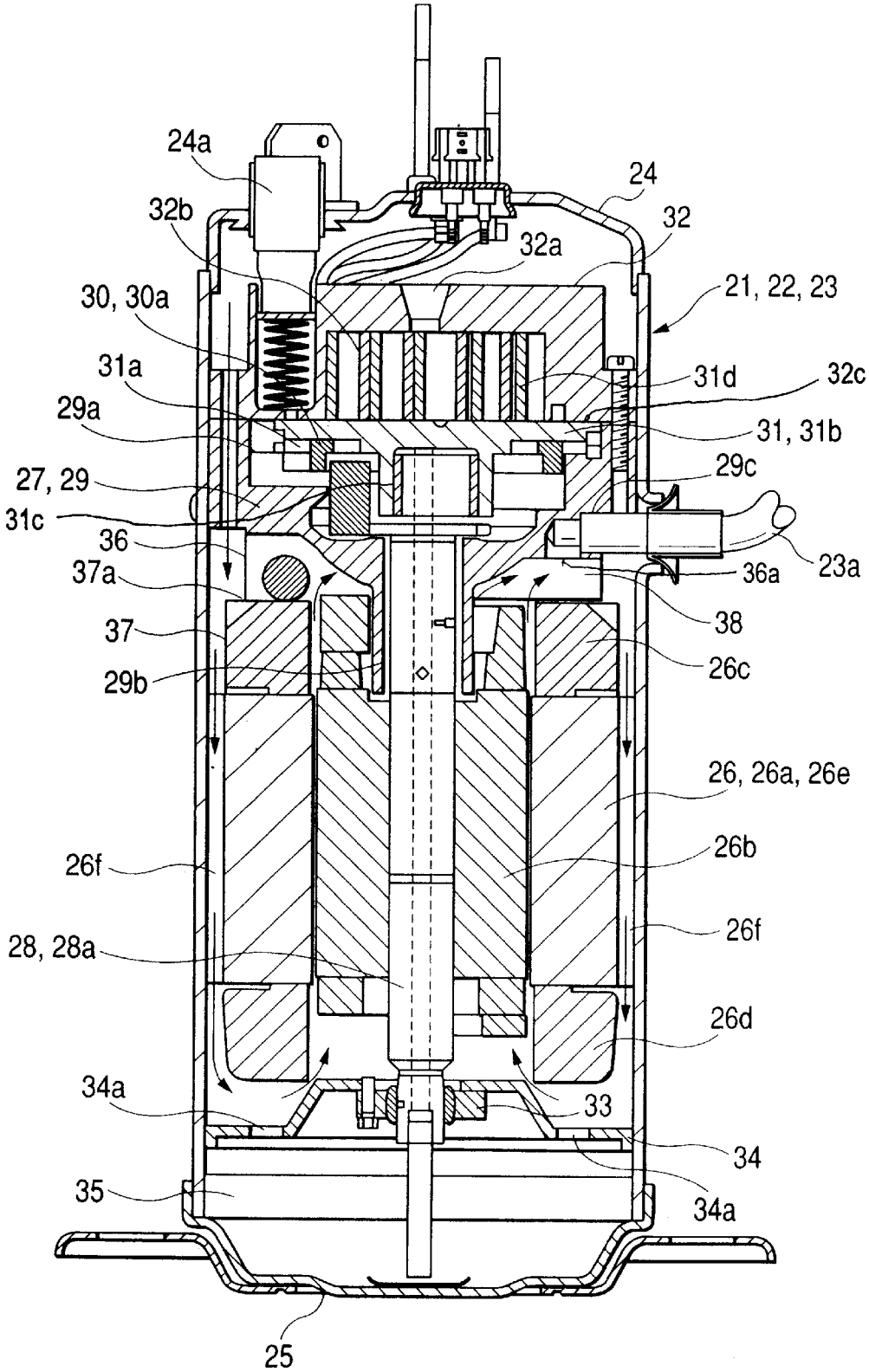
FIG. 6 (PRIOR ART)
FIG. 6 is a side cross-section view for showing an example of the conventional closed type motor-operated compressor.
Figure 7:
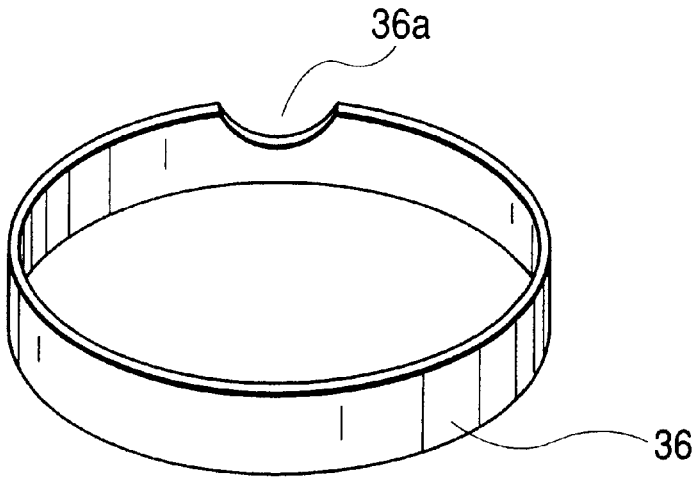
FIG. 7 (PRIOR ART)
FIG. 7 is a perspective view of an oil ring according to the conventional example.
Figure 8:
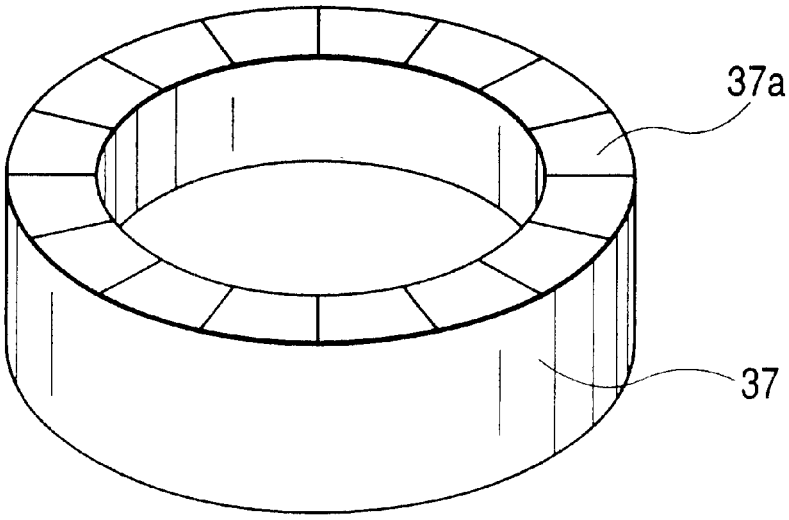
FIG. 8 (PRIOR ART)
FIG. 8 is a perspective view of an oil cover according to the conventional example.

FIG. 4 shows an example of the shape of the porous filter 18. The porous filter 18 has a ring-like shape, being concentric with the axis of the closed type motor-operated compressor, wherein the width thereof is so determined that it can enter within the inner/outer diameter size of the bottom 17*a* of the lower part oil cover 17, while the thickness at an arbitrary size for fitting to distance between the disc 14 and the lower part end coil 6*d*, appropriately. The filter 18 is formed by condensing a net made of wire of a fine diameter, or manufactured by a sintered alloy, etc., being formed from powder having an appropriate grain diameter.

As was explained in the above, the closed type motor-operated compressor, according to the embodiments of the present invention, has the structure, in which the discharge gas is guided to the filter with certainty, so as to pass the gas through it. Therefore, it is possible to reduce the flow-out of the refrigerating machine oil from the discharge pipe, and also to reduce an oil amount of the refrigerating machine oil adhering onto the inner wall of the pipe of the refrigerating cycle connected, thereby obtaining great improvement on the performance of heat exchange.

As was fully explained in the above, according to the present invention, it is possible to lower or reduced down the flow-out of the refrigerating machine oil from the discharge pipe of the closed type motor-operated compressor.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. A closed type motor-operated compressor, comprising:

a sealed container;

a compressor mechanism portion being provided in an upper portion within said sealed container;

a motor being connected with said compressor mechanism portion through a crankshaft;

an upper cover member provided between said compressor mechanism portion and said motor, said upper cover member and said motor defining a first shielding space being shielded from an inner wall of said sealed container;

a sub-bearing being provided below said motor and for supporting said crankshaft;

a support portion for supporting said sub-bearing, said support portion defining a second shielding space shielded from the inner wall of said sealed container between said motor and said support portion; and a filter for separating oil from refrigerant gas flowing into said second shielding space, the filter being disposed between said motor and said support portion.

2. A closed type motor-operated compressor, as defined in the claim 1, wherein said first shielding space and said second shielding space are conducted to each other through a space defined by an outer periphery of said motor and the inner wall of said sealed container.

3. A closed type motor-operated compressor, as defined in the claim 1, wherein said first shielding space is formed by said upper cover member having a cylindrical shape, being concentric with an axis of said compressor.

4. A closed type motor-operated compressor, as defined in the claim 3, wherein said upper cover member is formed of a material having an electric insulating property.

5. A closed type motor-operated compressor, as defined in the claim 3, wherein said upper cover member is formed of resin having an electric insulating property.

6. A closed type motor-operated compressor, as defined in the claim 1, wherein said filter is formed by condensing a net which is woven from wires of fine diameter.

7. A closed type motor-operated compressor, as defined in the claim 1, wherein said filter is formed from sintered alloy.

8. A closed type motor-operated compressor, as defined in the claim 1, wherein a discharge pipe for discharging the refrigerant gas to an outside of said sealed container is disposed within said first shielding space.

9. A closed type motor-operated compressor, comprising:

a sealed container;

a compressor mechanism portion being provided in an upper portion within said sealed container;

a motor being connected with said compressor mechanism portion through a crankshaft;

an upper cover member provided between said compressor mechanism portion and said motor, said upper cover member and said motor defining a first shielding space;

a support portion for supporting said motor, said support portion and said motor defining a second shielding space; and a filter for separating oil from refrigerant gas flowing into said second shielding space, the filter being disposed between said motor and said support portion.

10. A closed type motor-operated compressor, as defined in the claim 9, wherein said first shielding space and said second shielding space are conducted to each other through a space defined by an outer periphery of said motor and the inner wall of said sealed container.

11. A closed type motor-operated compressor, as defined in the claim 9, wherein said first shielding space is formed by said upper cover member having a cylindrical shape, being concentric with an axis of said compressor.

12. A closed type motor-operated compressor, as defined in the claim 11, wherein said upper cover member is formed of a material having an electric insulating property.

13. A closed type motor-operated compressor, as defined in the claim 11, wherein said upper cover member is formed of resin having an electric insulating property.

14. A closed type motor-operated compressor, as defined in the claim 9, wherein said filter is formed by condensing a net which is woven from wires of fine diameter.

15. A closed type motor-operated compressor, as defined in the claim 9, wherein said filter is formed from sintered alloy.

16. A closed type motor-operated compressor, as defined in the claim 9, wherein a discharge pipe for discharging the refrigerant gas to an outside of said sealed container is disposed within said first shielding space.

* * * * *